US010100583B2

(12) United States Patent
Fang et al.

(10) Patent No.: US 10,100,583 B2
(45) Date of Patent: Oct. 16, 2018

(54) CUTTING ELEMENTS WITH WEAR RESISTANT DIAMOND SURFACE

(71) Applicant: SMITH INTERNATIONAL, INC., Houston, TX (US)

(72) Inventors: Yi Fang, Orem, UT (US); J. Daniel Belnap, Lindon, UT (US); Scott L. Horman, Provo, UT (US); Ryan Davis, Pleasant Grove, UT (US); Haibo Zhang, Lindon, UT (US)

(73) Assignee: SMITH INTERNATIONAL, INC., Houston, TX (US)

( * ) Notice: Subject to any disclaimer, the term of this patent is extended or adjusted under 35 U.S.C. 154(b) by 1006 days.

(21) Appl. No.: 14/475,311

(22) Filed: Sep. 2, 2014

(65) Prior Publication Data

US 2015/0060151 A1 Mar. 5, 2015

Related U.S. Application Data

(60) Provisional application No. 61/873,694, filed on Sep. 4, 2013.

(51) Int. Cl.

| | |
|---|---|
| ***E21B 10/56*** | (2006.01) |
| ***E21B 10/46*** | (2006.01) |
| ***B24D 99/00*** | (2010.01) |
| ***B24D 3/10*** | (2006.01) |
| ***B24D 18/00*** | (2006.01) |

(52) U.S. Cl.

CPC ..... *E21B 10/56* (2013.01); *B24D 3/10* (2013.01); *B24D 18/0009* (2013.01); *B24D 99/005* (2013.01); *E21B 10/46* (2013.01)

(58) Field of Classification Search

CPC ..... E21B 10/46; B24D 3/10; B24D 18/0009; B24D 99/005

See application file for complete search history.

(56) References Cited

U.S. PATENT DOCUMENTS

| | | | |
|---|---|---|---|
| 4,869,329 | A | 9/1989 | Kar et al. |
| 6,460,636 | B1 | 10/2002 | Yang et al. |
| 7,543,662 | B2 | 6/2009 | Belnap et al. |
| 8,763,282 | B2 | 7/2014 | Brufau Guinovart et al. |
| 2006/0065447 | A1 | 3/2006 | Svendsen et al. |
| 2011/0132667 | A1 | 6/2011 | Smallman et al. |
| 2012/0261196 | A1 | 10/2012 | Yu et al. |
| 2012/0261197 | A1 | 10/2012 | Miess et al. |

FOREIGN PATENT DOCUMENTS

| | | |
|---|---|---|
| CN | 103924930 B | 1/2017 |

OTHER PUBLICATIONS

International Search Report and Written Opinion issued in International Patent Application PCT/US2014/053996 dated Nov. 28, 2014. 13 pages.

(Continued)

*Primary Examiner* — Wei Wang

(57) ABSTRACT

Cutting elements include polycrystalline diamond which may be attached to a substrate. The polycrystalline diamond may have a ratio of cubic to hexagonal cobalt crystalline structures of greater than about 1.2. The polycrystalline diamond may have a high level surface compressive stress of greater than about 500 MPa.

12 Claims, 6 Drawing Sheets

(56) References Cited

OTHER PUBLICATIONS

International Preliminary Report on Patentability issued in International Patent Application PCT/US2014/053996 dated Mar. 8, 2016. 10 pages.
First Office Action issued in Chinese Patent Application 201480048838.6 dated Dec. 5, 2016. 14 pages.
Xu Guo Ping, et al., "Sintering Process of Polycrystalline Diamond Compact under High Pressure", Chinese Journal of High Pressure Physics vol. 25, No. 3, Jun. 2011, published Jun. 2011.†
J. W. Paggett, et al., "Residual stress and stress gradients in polycrystalline diamond compacts", International Journal of Refractory Metals & Hard Materials 20 (2002) 187-194, published Oct. 31, 2001.†
Chen Feng, et al., "Thermal residual stress of polycrystalline diamond compacts", Transactions of Nonferrous Metals Society of China 20(2010) 227-232, published Apr. 7, 2009.†
Shane A. Catledge, et al., "Micro-Raman stress investigations and X-ray diffraction analysis of polycrystalline diamond (PCD) tools", Diamond and Related Materials 5 (1996) 1159-1165, published Feb. 6, 1996.†

† cited by third party

CUTTING ELEMENTS WITH WEAR RESISTANT DIAMOND SURFACE

CROSS REFERENCE TO A RELATED APPLICATION

This Patent Application claims the benefit of U.S. Provisional Patent Application Ser. No. 61/873,694 filed on Sep. 4, 2013, which is hereby incorporated by reference in its entirety.

BACKGROUND

Cutting elements, such as those used with bits for drilling earth formations, known in the art include a diamond surface layer or diamond table disposed onto a carbide substrate. The diamond table is used to provide properties of improved wear and abrasion resistance, relative to the underlying substrate, and the substrate is used to provide an attachment structure to facilitate attachment of the cutting element to an end-use machine tool, e.g., a drill bit or the like.

Such known cutting elements have a diamond layer or diamond table formed from polycrystalline diamond (PCD) and make use of a carbide substrate such as WC-Co. While the diamond layer operates to provide improved wear and abrasion resistance to the cutter, e.g., when compared to cutting elements having a wear surface formed from tungsten carbide, the diamond layer is known to have a coefficient of thermal expansion that is much lower than that of the underlying substrate. Accordingly, the high-pressure/high-temperature process used to sinter the diamond layer, form the PCD and attach the PCD layer to the underlying substrate is one that is known to produce a cutting element having residual compressive stress. The presence of such residual compressive stress induced on the diamond layer and substrate may result in cutting element breakage or diamond layer delamination under drilling conditions.

Attempts to improve the service life of such cutting elements have focused on reducing the residual compressive stress at the diamond layer-substrate interface, thereby reducing or minimizing the event of breakage, fracture or delamination under drilling conditions. While such efforts may be useful in reducing or minimizing instances of breakage or delamination, such performance gains are provided at the expense of compromising the wear resistance and resistance to crack initiation at the surface of the diamond table, which also operates to limit the effective service life of the cutting element.

SUMMARY

Cutting elements as disclosed herein include a diamond surface formed from polycrystalline diamond. In an example, the diamond surface is constructed having a dome-shaped outer surface. The dome-shaped outer surface may have a radius of curvature of between about 3.5 mm to 13.3 mm. When provided in the form of a diamond table, the thickness at the dome-shaped outer surface is greater than about 0.6 mm, greater than about 0.8 mm, or between about 0.6 mm to 3 mm inches.

The cutting element may be formed entirely from polycrystalline diamond or may include a polycrystalline diamond table that is attached to a substrate, e.g., that is bonded thereto. One more transition layers may be interposed between the substrate and the diamond table, and the diamond table may be formed from one or more polycrystalline diamond layers. The diamond surface may have a high level compressive stress of greater than about 500 MPa, greater than about 900 MPa, greater than about 1,000 MPa, or in the range of from about 900 to 1,200 MPa.

In an example, polycrystalline diamond useful for forming cutting elements include a controlled ratio of different cobalt crystal structure phases of greater than about 1.2, from about 1.5 to 2.5, or from about 1.6 to 1.8 cubic cobalt/hexagonal cobalt.

Cutting elements are made by subjecting an assembly of diamond grains to high-pressure/high-temperature processing conditions in the presence of a catalyst material to form the polycrystalline diamond. When a substrate is used, the substrate may be attached to the polycrystalline diamond in table form during the high-pressure/high-temperature processing to thereby form the cutting element. If desired, cutting elements can be formed at ultra-high pressure conditions. The cutting element may be treated to produce the desired high level compressive stress on the surface of the polycrystalline diamond as disclosed above.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

These and other features and advantages of cutting elements as disclosed herein will be appreciated as the same becomes better understood by reference to the following detailed description when considered in connection with the accompanying drawings wherein.

DETAILED DESCRIPTION

In an example, cutting elements as disclosed herein include a body or substrate having a diamond table formed from polycrystalline diamond (PCD) disposed thereon that forms a working or wear surface of the cutting element. In another example, cutting elements as disclosed herein may be formed entirely from PCD, i.e., not include a substrate. The PCD may have a dome-shaped upper surface, and may have a high surface compressive stress of greater than about 900 MPa. The PCD may also be engineered having a controlled cobalt phase. In some embodiments, cutting elements constructed in this manner provide improved properties of wear resistance and resistance to cracks, thereby increasing the operational service life of such cutting elements.

Figure 1:
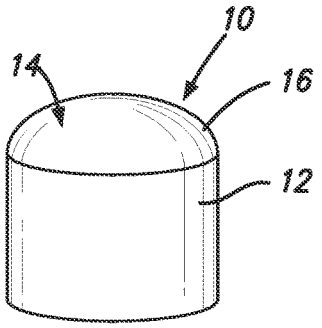
FIG. 1 illustrates a perspective side view of an example cutting element as disclosed herein.
Figure 2:
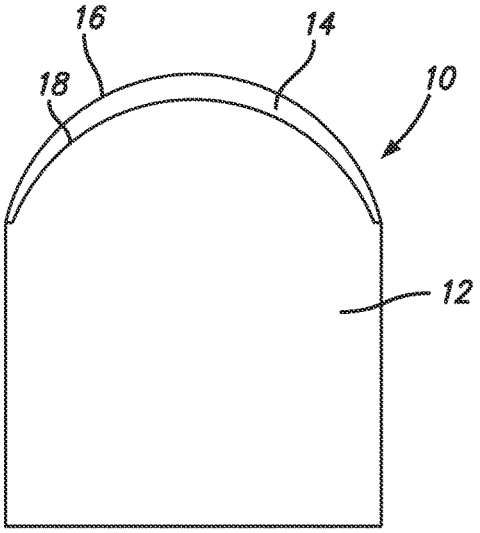
FIG. 2 illustrates a side cross-sectional view of an example cutting element as disclosed herein.

FIGS. 1 and 2 illustrate an example cutting element 10 as disclosed herein including a body 12 or substrate having a sidewall construction that is generally cylindrical in shape. The cutting element includes a diamond table 14 coated or otherwise disposed on the substrate, where the diamond table forms a working or wear surface 16 of the cutting element. Referring to FIGS. 1 and 2, the example cutting element 10 includes the diamond table 14 coated or otherwise disposed along a top end of the body 12. In an example, the diamond table is configured having a dome-shaped top or upper surface that closely relates to the configuration of the underlying body top end.

Figure 7:
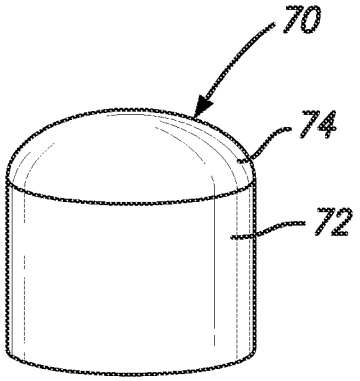
FIG. 7 illustrates a perspective side view of an example cutting element as disclosed herein.
Figure 8:
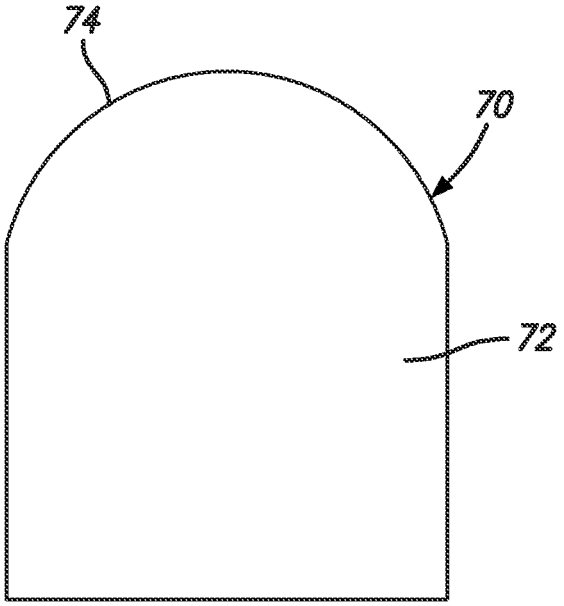
FIG. 8 illustrates a side cross-sectional view of an example element as disclosed herein.

FIGS. 7 and 8 illustrate an example cutting element 70 as disclosed herein including a body 72 and a wear surface 74 that are each constructed from PCD, i.e., in such example the cutting element does not include a separate substrate and is entirely formed of PCD. The cutting element 70 is configured having a dome-shaped top or upper wear surface.

The diamond table or diamond surface may be configured having a constant radius of curvature, or having a variable radius of curvature that defines the dome-shaped configuration. In such example, the radius of curvature defining the dome-shaped top surface may be from about 3.5 mm to 13.3 mm inches, 6.5 mm to 13.3 mm inches, or about 8 mm to 13.3 mm. The radius of curvature may be selected in view of the particular substrate or body diameter, and/or cutting element end-use application. The radius of curvature is understood to vary depending on such features as the diameter of the substrate or body, and/or the end-use application. In an example, the ratio of the dome radius of curvature to the substrate or body diameter may be in the range of from about 0.5 to 1. While the dome-shaped diamond table or surface has been characterized by a radius of curvature, it is to be understood that the diamond table or surface as disclosed herein may be configured having a generally dome-shaped surface that is not perfectly radiused, in which case the dome-shaped surface is roughly approximated by a radius of curvature that substantially represents a dome-shaped configuration.

In an example, the diamond table or surface may be configured having a pointed geometry with an apex that is relatively sharp that forms a tip of the diamond table or surface. In such a pointed-tip embodiment, the apex of the diamond table or surface may have a radius of curvature of from about 1.3 to 3.2 mm, or from about 2.3 to 2.8 mm. The diamond table or surface extending radially away from the apex or tip may have a concave, convex, and/or a straight configuration.

As illustrated in FIG. 2, the cutting element 10 has a smooth interface 18 between the substrate 12 and the diamond table 14. As used herein, the term "smooth" is used to define an interface surface that is continuous and without or substantially free from any surface irregularities, e.g., a surface that is curved or that has a radius of curvature. It is understood that cutting elements as disclosed herein may be configured having an interface between the substrate and the diamond table that is not smooth, e.g., that includes one or more surface features or irregularities that detract from an otherwise continuous or smooth interface, and that may operate to provide an improved degree of mechanical attachment at the interface between the body and the diamond table. In the example where the cutting element is formed entirely from diamond, there is no interface between the diamond portion forming the body and the surface.

The cutting element may include a diamond table provided in the form of a single layer or multiple layers, and in an example, the diamond table is formed from PCD. As illustrated in FIG. 2, in an example, the diamond table 14 of cutting element 10 is formed from a single diamond layer. It is understood that cutting elements as disclosed herein may have a diamond table that is formed from more than one diamond layers. While the example of FIG. 2 illustrates a cutting element where the diamond table 14 is disposed or otherwise attached directly to the substrate 12, cutting elements as disclosed herein may include one or more transition layers interposed between the diamond table and the substrate.

Figure 3:
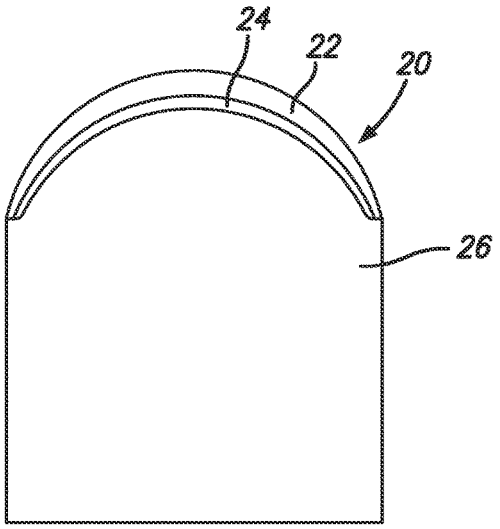
FIG. 3 illustrates a side cross-sectional view of an example cutting element as disclosed herein having at least one transitional layer.

FIG. 3 illustrates an example cutting element 20 including a diamond table 22 that is disposed onto and bonded with a transition layer 24, which transition layer 24 is interposed between the diamond table 22 and the substrate 26 and is bonded to the substrate. While a particular example has been illustrated having one transition layer, intervening between the diamond layer and the substrate, it is to be understood that cutting elements as disclosed herein may have more than one transition layer, depending on such factors as the materials used to form the diamond table and the substrate, and the particular end-use application.

In an embodiment, the PCD used for making cutting elements as disclosed herein includes a material microstructure made up of a matrix phase of bonded-together diamond grains with a plurality of interstitial regions dispersed within the matrix phase, where the interstitial regions are populated with a catalyst material such as that used to form the PCD at high-pressure/high-temperature (HPHT) conditions. The catalyst materials include conventional catalyst materials such as those selected from Group VIII of the CAS version of the Periodic Table. The interstitial regions may also include particles of metal carbides, which include elements such as W, Nb, Ti, Ta, or the like. In an example, the PCD may have a diamond volume content of from about 80 to 99, from about 88 to 98, or from about 90 to 96 percent based on the total volume of the materials used to form the PCD. In an example, the PCD may have a catalyst volume content of from about 1 to 20, from about 2 to 12, or from about 4 to 10 percent based on the total volume of the materials used to form the PCD. In an example, the PCD has a diamond volume content of about 92 percent or greater by volume (e.g., greater than about 92 percent by volume), and a catalyst content of about 8 percent or less by volume (e.g., less than about 8 percent by volume).

In an example where no substrate is used, the catalyst materials used to form the PCD may be either the Group VIII materials mentioned above, or alternatively the catalyst can be selected from non-metal catalysts such as the alkaline earth family of carbonates including but not limited to magnesium carbonate, calcium carbonate, or the like.

In an example, the PCD used to form cutting elements as disclosed herein includes cobalt, where the cobalt is disposed within interstitial regions. In an example, the PCD is engineered having controlled cobalt crystal structures disposed therein. Specifically, PCD used for forming the diamond table or surface has a desired amount or ratio of different crystal structures of cobalt disposed therein. In an example, the different cobalt crystal structures are high-temperature stable cubic cobalt, and room-temperature stable hexagonal cobalt. It has been discovered that PCD formed having a high ratio of cubic cobalt relative to hexagonal cobalt provides or contributes to increased diamond table wear resistance (as measured by G ratio wear test).

In an example, it is desired that the PCD useful for forming cutting elements as disclosed herein have a ratio of cubic cobalt/hexagonal cobalt that is greater than about 1.2, from about 1.5 to 2.5, or from about 1.6 to 1.8. In an example, the different cobalt crystal structures present in the cobalt phases in the PCD are identified by X-ray diffraction parallel beam method. The method is used a number of times over different locations along the diamond table, and the quantitative ratio of the different cobalt crystal structures in the cobalt phases is determined by using X-ray diffraction companion software. The desired ratio noted above is determined from the peak intensity ratio of the X-ray diffraction spectrum at 2Θ. In an example, the ratio of the peak intensity for the cubic cobalt/hexagonal cobalt is I (2Θ=7.22°/I (2Θ=51.15°) as noted above. In physics, Bragg's Law indicates that the incident X-ray would produce a diffraction peak when their reflections off the crystal planes interfered constructively. This condition can be expressed by the equation: $n\lambda=2d \sin \theta$. Where n is an integer, λ is the wavelength of incident x-ray, d is the spacing between the specific crystal planes, and θ is the angle between the incident x-ray and the scattering planes.

In an example, the one or more transition layers may include composites of diamond crystals, cobalt and particles of a metal carbide or metal carbonitride, such as a carbide or carbonitride of W, Ta, Ti or mixtures thereof. For example, the metal carbide may be tungsten carbide, which may be cemented carbide, stoichiometric tungsten carbide, cast tungsten carbide or a plasma sprayed alloy of tungsten carbide and cobalt. It is well known that various metal carbide or carbonitride compositions and binders may be used, in addition to tungsten carbide and cobalt. Thus, references to the use of tungsten carbide and cobalt are for illustrative purposes, and no limitation on the type metal carbide or carbonitride or binder used is intended.

The particle size of the carbide may be less than the particle size of the diamond crystals in the transition layer. The one or more transition layers may be formed in a conventional manner. In an example, diamond crystals and cobalt are ball milled together and are then ball milled with the addition of tungsten carbide.

When multiple transition layers are present, the transition layer near the diamond table may contain a greater proportion of diamond crystals, while the transition layer near the substrate may contain a greater proportion of tungsten carbide. The cutting element may include any number of transition layers. More than one transition layer may create a gradient with respect to the diamond content where the proportion of diamond content decreases between the transition layers, moving inwardly toward the substrate. For example, an outer transition layer positioned adjacent the diamond table may have a diamond content greater than an inner transition layer positioned adjacent the substrate.

A cutting element including a single transition layer may also include a gradient of diamond content, where a region of the transition layer near the polycrystalline diamond layer has a diamond content greater than that of a region of the transition layer near the substrate. The gradient within the single transition layer, for example, may be generated by methods known in the art.

The presence of a transition layer interposed between the diamond table and the substrate may create a gradient with respect to the thermal expansion coefficients for the layers. The magnitude of residual stress at the interfaces depends on the disparity between the thermal expansion coefficients and elastic constants for the juxtaposed layers. The coefficient of thermal expansion for the substrate may be greater than the transition layer, which may be greater than that of the polycrystalline diamond layer. The presence of a transition layer between the diamond table and substrate also creates a gradient with respect to elasticity, and minimizes a sharp drop in elasticity between the polycrystalline diamond layer and the substrate that would otherwise contribute to chipping of the diamond table from the cutting element.

The ratio of the cobalt crystal structures may be controlled in the one or more transition layers. For example, depending on the number of transition layers used and/or the particular composition of the diamond table, it may be desired that ratio of the different cobalt crystal structures be as disclosed above for the PCD diamond table. In such an example, the ratio of the different cobalt crystal structures may be less in the one or more transition layers than in the PCD diamond table, where in all of the transition layers there is relatively more cubic cobalt present. In another example, the ratio of the different cobalt crystal structures in the transition layer or layers may be outside of the controlled ratio in the PCD diamond table, e.g., one or more of the transition layers may have a higher level of hexagonal cobalt than cubic cobalt so that the ratio is less than 1.2.

In an example, the cutting elements as disclosed herein have a diamond table with a thickness at the top surface that is greater than about 0.6 mm, or greater than about 0.8 mm. In an example, the diamond table has a thickness of between about 0.6 mm to 3 mm, between about 0.6 to 2.3 mm, or between about 0.8 mm to 1.8 mm. In an example, the diamond table thickness is approximately 1.3 mm. In other examples the PCD thickness may be defined as a percentage of the dome-shaped region height. Using this relationship, the PCD thickness may be in the range of about 0.1 to 0.8, 0.2 to 0.7, or 0.3 to 0.6 times the height of the dome shaped region. In examples where the cutting element is formed entirely of PCD, the diamond table thickness is the length of the cutting element.

Figure 9:
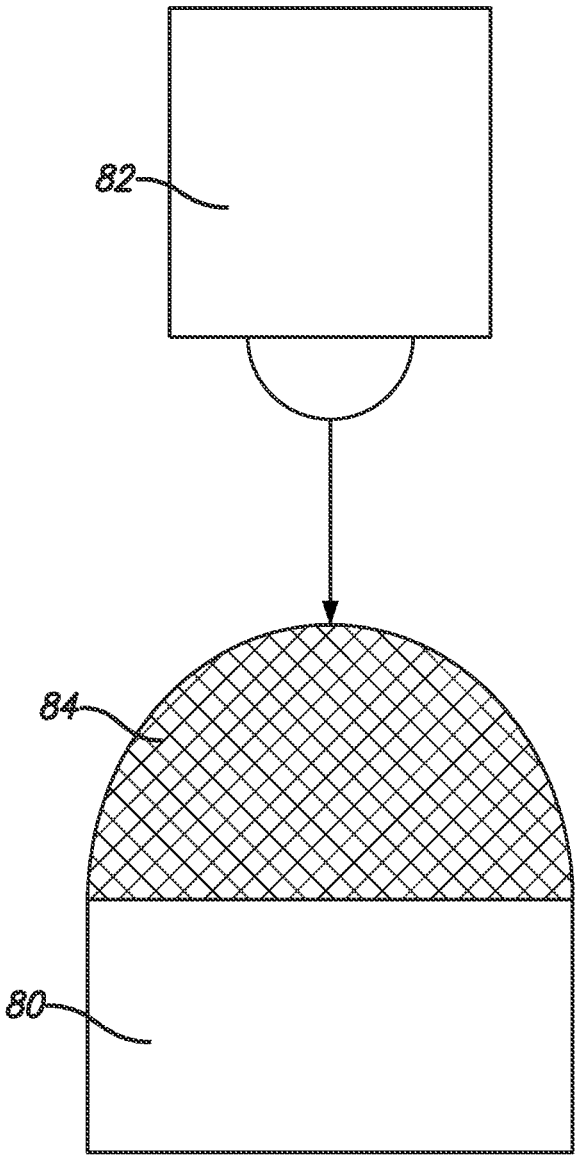
FIG. 9 illustrates a test configuration for a compressive stress analysis.

Cutting elements as disclosed herein are specially engineered having a high diamond surface compressive stress as contrasted to conventional diamond enhanced cutting elements (e.g., diamond enhanced inserts). Cutting elements formed without a substrate as disclosed herein are engineered having a high diamond surface compressive stress of greater than about 500 MPa, greater than about 580 MPa, greater than about 600 MPa, greater than about 700 MPa, in a range of about 500 to 1100 MPa, in a range of about 600 to 1100 MPa, or in a range of about 600 to 900 MPa. Cutting elements without substrates could be, e.g., cobalt or carbonate type catalyst polycrystalline diamond elements that are formed without a substrate (e.g., a cutting element without a substrate could be formed using an $MgCO_3$ catalyst material). Cutting elements attached with a substrate (e.g., formed with a substrate) as disclosed herein may also be engineered having a high diamond surface compressive stress of greater than about 900 MPa, greater than about 1,000 MPa, in a range of about 900 to 1,400 MPa, or in a range of about 900 to 1,200 MPa. The surface compression stress is measured, e.g., by using Raman spectroscopy as described below as follows:

A schematic of a configuration useful for measuring such tests is shown in FIG. 9. Laser probe 82 is directed at the apex of the polycrystalline diamond dome 84 of cutting element 80. Diamond has a single Raman-active peak, which under stress free conditions is located at $\omega_0=1332.5$ $cm^{-1}$. For polycrystalline diamond, this peak is shifted with applied stress according to the relation:

$$\Delta\omega = \frac{\omega_0\gamma}{B}\sigma_H$$

where $\Delta\omega$ is the shift in the Raman frequency, $\gamma$ is the Grunesian constant, equaling 1.06, B is the bulk modulus, equaling 442 GPa, and $\sigma_H$ is the hydrostatic stress. $\sigma_H$ is defined as:

$$\sigma_H = \frac{\sigma_1 + \sigma_2 + \sigma_3}{3}$$

where $\sigma_1$, $\sigma_2$, and $\sigma_3$ are the three orthogonal stresses in an arbitrary coordinate system, the sum of which equals the first stress invariant. In the center of the apex of an insert, it is reasonable to assume equibiaxial conditions ($\sigma_1=\sigma_2=\sigma_B$ and $\sigma_3=0$). In which case, the relation between the biaxial stress $\sigma_B$ and the peak shift is given by:

$$\Delta\omega = \frac{2\omega_0\gamma}{3B}\sigma_B.$$

The cutting elements were characterized using Raman spectroscopy and fatigue contact testing. The equipment used to collect the Raman spectra employed a near-infrared laser operating at 785 nm, a fiber optic lens/collection system and a spectrometer incorporating a CCD-array camera. The peak centers were determined by fitting a Gaussian curve to the experimental data using intrinsic fitting software. The Gaussian expression is given by:

$$I(x) = I_0\exp\left[\ln 0.5\frac{(x-\omega_C)^2}{(w/2)^2}\right]$$

where I(x) is the intensity as a function of position, $I_0$ is the maximum intensity, $\omega_C$ is the peak center, and w is the peak width, i.e., the full width at half maximum intensity. In this analysis, the fitted peak center was used to determine the compressive stress.

Cutting elements as disclosed herein may be formed by subjecting an assembly including a volume of diamond grains positioned adjacent a substrate to high-pressure/high-temperature (HPHT) processing conditions. In embodiments where the cutting element includes one or more transition layers, the precursor materials useful for forming such transition layer(s) are disposed within the assembly between the volume of diamond grains and the substrate. The diamond grains and any transition layer material may be provided in powder form or other green-state form, e.g., in the form of a bound-together construction such as a tape or the like where the diamond grains or transition layer materials are bound together using a binder or the like for purposes of facilitating assembly and manufacturing. Cutting elements made entirely from PCD, i.e., not including a substrate, are formed in a similar manner but without the presence of a substrate in the assembly (and may also include one or more transition layers).

Briefly, to form the polycrystalline diamond layer, an unsintered mass of diamond crystalline particles is placed within a metal enclosure or assembly of a reaction cell of a HPHT apparatus. A metal catalyst, such as cobalt, and tungsten carbide particles may be included with the unsintered mass of crystalline particles. The reaction cell is then placed under HPHT processing conditions sufficient to cause the intercrystalline bonding between the diamond particles. It should be noted that if too much additional non-diamond material, such as tungsten carbide or cobalt is present in the powdered mass of crystalline particles, appreciable intercrystalline bonding is prevented during the sintering process. Such a sintered material where appreciable intercrystalline bonding has not occurred is not within the definition of PCD. Any transition layer may similarly be formed by placing an unsintered mass of the composite material containing diamond particles, tungsten carbide and cobalt within the HPHT apparatus. The reaction cell is then placed under HPHT processing conditions sufficient to cause sintering of the material to create the transition layer. Additionally, a preformed metal carbide substrate may be included. In which case, the processing conditions operate to both sinter the PCD and bond the so-formed PCD table to the metal carbide substrate.

In an example embodiment, the cutting elements as disclosed herein are formed by subjecting the assembly to a HPHT process condition where the pressure is between about 5,500 to 7,000 MPa and the temperature is between about 1,300 to 2,000° C. for a period of time sufficient to ensure formation of the fully sintered PCD table and attachment of the PCD table with the substrate (when a substrate is used). In some instances it is desired that cutting elements as disclosed herein be sintered at HPHT process conditions including ultra-high pressure conditions of greater than about 7,000 MPa, and in the range of from about 7,500 to 15,000 MPa, with processing temperatures in the range 1,500 to 2,500° C.

In one example, the desired high level diamond surface compressive stress of greater than about 900 MPa is achieved by in-press quenching, i.e., by reducing the temperature of the HPHT process after PCD formation at a rapid rate. For example, rather than controlling the temperature reduction from the HPHT processing temperature so that it occurs over an extended period of time, the temperature is allowed to drop from the HPHT processing temperature rapidly, e.g., by heater shut off or shut down, in a manner calculated to impose the desired high level of surface compressive stress. In an example, once the PCD table has been formed, the HPHT processing temperature of approximately 1,500° C. is reduced to approximately 300° C. over a period of approximately 5 minutes. A desired high level surface compressive stress may be achieved by in-press quenching at a rate of at least about 6° C./sec from the HPHT processing condition used to form the PCD table, or in the range of from about 6 to 15° C./sec.

In another example, the desired diamond high level surface compressive stress of greater than about 900 MPa is achieved by treating the cutting element, as formed by the HPHT conditions disclosed above, in a manner that that does not involve in-press quenching. In an example, the treatment may include subjecting the cutting element to multiple impact forces. This may be accomplished by high-velocity impacts by hard particles, media or members against the PCD surface by methods such as grit blasting, high energy tumbling or shot peening. In the case of hard particle impacts, the hardness of the particles can be in the range of about 100 to 4,000 kg/mm$^2$. In an example, such hard particles may be directed at the PCD surface by air pressure, e.g., of from about 30 to 200 psi, through a suitably sized nozzle, e.g., having a nozzle diameter of about 1.6 mm 6.4 mm, to provide the desired high level surface compressive stress disclosed herein.

In an example, the cutting element may be subjected to high-energy tumbling where after the cutting element is sintered it is removed from the HPHT apparatus and placed into a tumbler including a desired media. In an example, the media disposed within the tumbler can be tungsten carbide balls or the like. The cutting element is subjected to tumbling at a predetermined rate or RPMs, for a designated amount of time sufficient to cause the cutting element to be subjected to impact forces sufficient to impose the desired compressive stress onto the surface of the diamond table. In an example, the cutting element is disposed within a tumbler such as one manufactured by Vibra Finish, Inc., of Simi Valley, Calif., which includes a chamber containing a number of tungsten carbide balls having an average diameter in the range of from about 1.6 mm to 12.7 mm where vibration is caused by an offset motor attached to the chamber. The cutting element is tumbled at a motor speed of about 200 to 1,200 RPMs for a period of time of about 60 to 240 minutes.

In one example, cutting elements as constructed herein were subjected to high-velocity impacts using silicon carbide grit sized between about 50 to 70 mesh driven by an air pressure of approximately 70 psi with a nozzle size of approximately 3 mm to induce a PCD table compressive surface stress of approximately 440 MPa. Further exposing the PCD surface of such cutting elements to a high-energy vibrafinish tumbling system, driven by an offset motor operating at approximately 1,100 RPM with approximately 3 mm sized media, produced an additional surface compressive stress of 150 MPa, resulting in a total induced PCD surface compressive stress of approximately 590 MPa, relative to an untreated surface. This type of surface treatment, in combination with designs which contain substrates and the quenching processes described earlier can combine to produce compression stresses in excess of 900 MPa. These are representative of but a few different techniques useful for producing cutting elements as disclosed herein having a high level of PCD surface compressive stress of, e.g., greater than about 900 MPa. It is to be understood that the above-disclosed treatment techniques can be used alone or in various combinations with one another to produce cutting elements having the desired high level PCD surface compressive stress. For example, it is known that a tungsten carbide substrate contributes 100-300 MPa to the compressive residual stress state, therefore in the case where there is no substrate a surface compressive stress in excess of about 500 to 800 MPa may be achieved by the techniques disclosed herein.

In an example, the desired ratio of cobalt crystal structures is obtained by modifying the diamond powder mixture to include a desired pre-mixed cubic Co content, by controlling the HPHT process, such as cooling rate, by post-press heat treatment, or the like. In some examples, the diamond powder mixture includes about 2 to about 10 wt % Co. In some embodiments, the diamond powder mixture includes about 3 to about 8 wt % Co or about 4 to about 6 wt % Co. In some embodiments, the diamond powder mixture includes 6 wt % Co. In some examples, the desired ratio of cobalt crystal structures is achieved by using higher HPHT pressures (e.g., 10 to 20% above the standard pressing pressure level for making diamond enhanced inserts), sintering at a temperature in the range of 1,400 to 1,520° C., and quickly cooling down to room temperature at the rate of at least about 6° C./sec. In some embodiments, the HPHT pressure may be about 5000 to 6600 MPa, about 5700 to 6300 MPa, about 5400 MPa, or about 6000 MPa.

In some embodiments, cutting elements as disclosed herein display an improved degree of wear resistance and resistance to crack formation when compared to conventional diamond enhanced cutting elements. For example, cutting elements as disclosed herein provide a PCD wear resistance (according to G ratio wear test) of greater than about 15 percent, and in some instances greater than 25 percent, when compared to conventional diamond enhanced cutting elements. Thereby, providing improved performance and prolonged service during end-use applications (e.g., during drilling operation). Both the high level diamond table surface compressive stress and the diamond controlled cobalt crystalline structure are believed to contribute to the improved wear properties of the cutting elements as disclosed herein.

Cutting elements as disclosed herein may be used in a number of different applications, such as tools for mining, cutting, machining, milling and construction applications, where properties of wear resistance, abrasion resistance, toughness, and mechanical strength, and/or reduced thermal residual stress, e.g., caused by mismatched coefficient of thermal expansion, are highly desired. Cutting elements as disclosed herein are particularly well suited for use in machine tools and drill and mining bits such as roller cone rock bits, percussion or hammer bits, drag bits, fixed blade bits, and the like used in subterranean drilling applications. Accordingly, it is to be understood that the cutting elements as disclosed herein may be used in any of the above-noted types of drill and mining bits depending on the particular end-use application.

Figure 4:
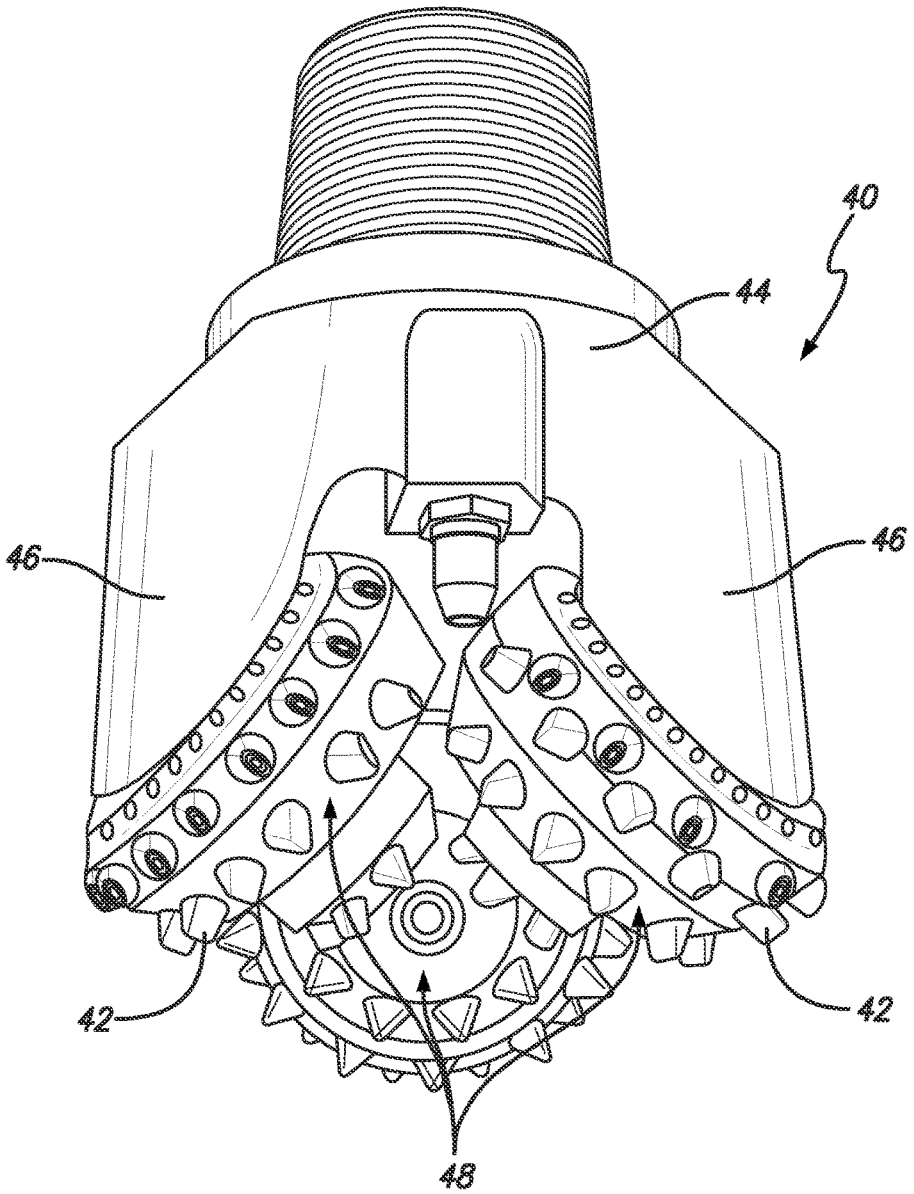
FIG. 4 is a perspective view of a rotary cone drill bit including example cutting elements as disclosed herein.

FIG. 4 illustrates a rotary or roller cone drill bit in the form of a rock bit 40 including a number of the cutting elements 42 as disclosed herein. The rock bit 40 includes a body 44 having three legs 46, and a roller cutter cone 48 mounted on a lower end of each leg. The cutting elements or inserts 42 may be fabricated according to the method described above. The cutting element or inserts 42 are provided in the surfaces of each cutter cone 48 for bearing on a rock formation being drilled.

Figure 5:
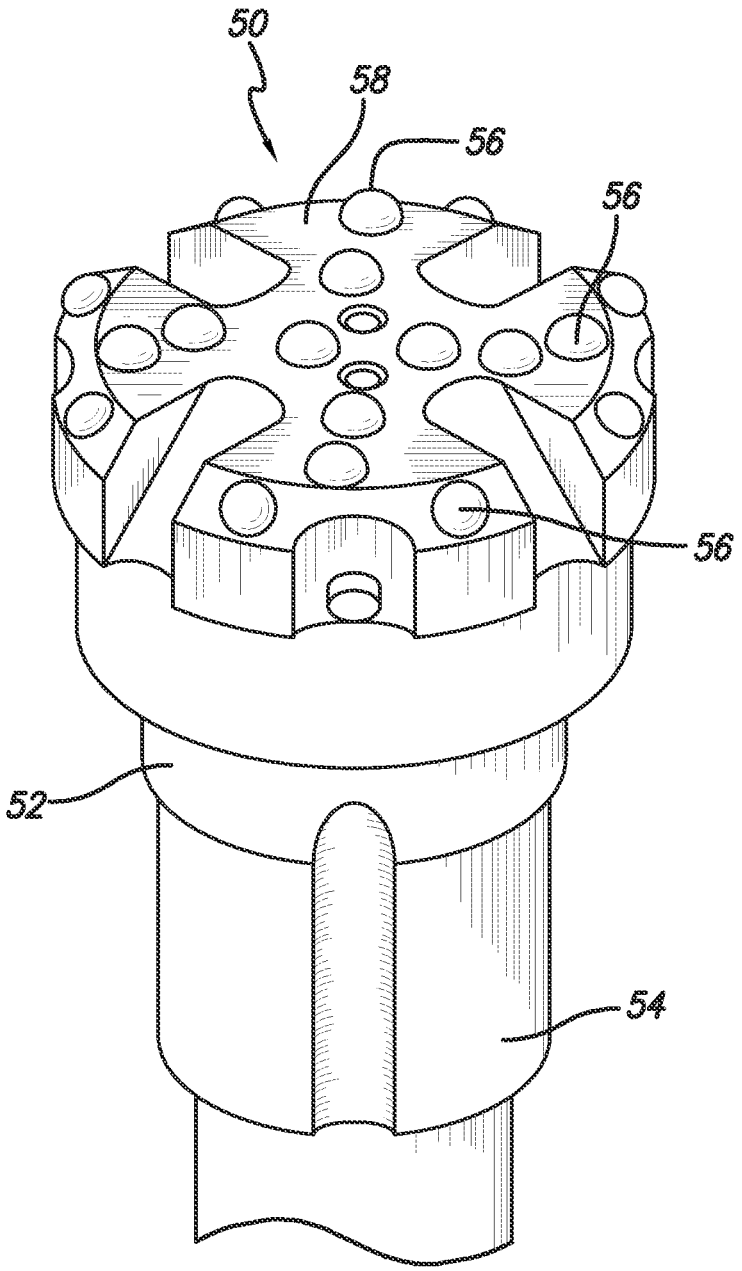
FIG. 5 is a perspective view of a hammer drill bit including example cutting elements as disclosed herein.

FIG. 5 illustrates the cutting elements or inserts described above as used with a percussion or hammer bit 50. The hammer bit includes a hollow steel body 52 having a threaded pin 54 on an end of the body for assembling the bit onto a drill string (not shown) for drilling oil wells and the like. A plurality of the cutting elements 56 as disclosed herein are provided in the surface of a head 58 of the body 52 for bearing on the subterranean formation being drilled.

Figure 6:
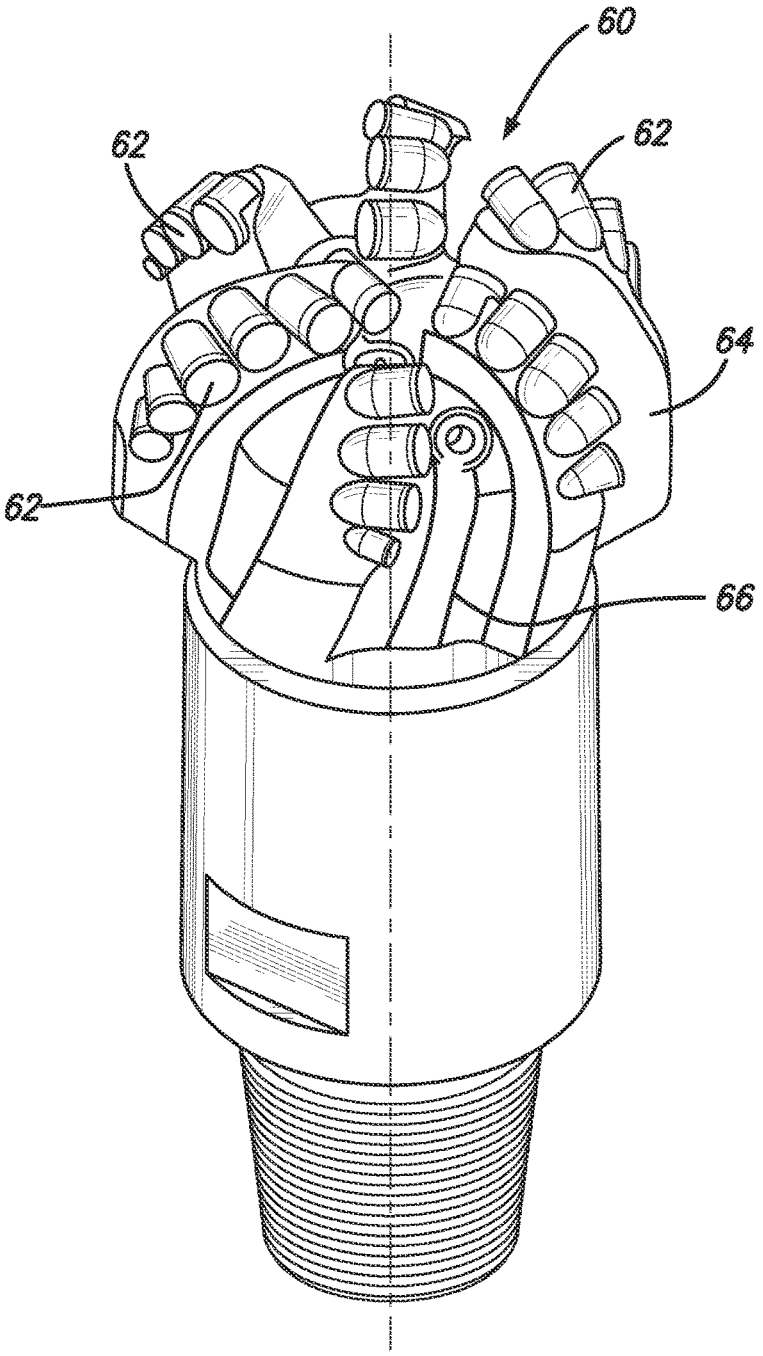
FIG. 6 is a perspective view of a drag drill bit including example cutting elements as disclosed herein.

FIG. 6 illustrates a drag bit 60 for drilling subterranean formations including a number of the cutting elements 62 that are each attached to blades 64 that extend from a head 66 of the drag bit for cutting against a subterranean formation being drilled.

Although only a few example embodiments have been described in detail above, those skilled in the art will readily appreciate that many modifications are possible in the example embodiments without materially departing from the concepts as disclosed herein. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A cutting element comprising polycrystalline diamond, wherein the polycrystalline diamond has an outer surface with a surface compressive stress of about 500 to 1,500 MPa, and wherein the polycrystalline diamond comprises a ratio of cubic cobalt to hexagonal cobalt of about 1.2 to 2.5.

2. The cutting element as recited in claim 1 wherein the polycrystalline diamond is in the form of a diamond table that is bonded to a substrate, and wherein the surface compressive stress is greater than about 900 MPa.

3. The cutting element as recited in claim 2 comprising one or more transition layers between the diamond table and the substrate.

4. The cutting element as recited in claim 3 wherein the one or more transition layers comprise a relatively lesser amount of cubic cobalt to hexagonal cobalt than the polycrystalline diamond.

5. The cutting element as recited in claim 2 wherein the compressive stress is in a range of about 900 to 1,500 MPa.

6. The cutting element as recited in claim 2 wherein the diamond table has a dome-shaped outer surface having a thickness of between about 0.6 mm to 3 mm inches.

7. The cutting element as recited in claim 1 wherein the polycrystalline diamond is in the form of a diamond table that is not bonded to a substrate, and wherein the surface compressive stress is in a range of about 500 to 1100 MPa.

8. A bit for drilling subterranean formations comprising a number of the cutting elements as recited in claim 1 operatively attached thereto.

9. A cutting element comprising polycrystalline diamond having a ratio of cubic cobalt to hexagonal cobalt of about 1.2 to 2.5, wherein the cutting element includes one or more transition layers extending from the polycrystalline diamond, and wherein the one or more transition layers comprise a relatively lesser amount of cubic cobalt to hexagonal cobalt than the polycrystalline diamond.

10. The cutting element as recited in claim 9 wherein the polycrystalline diamond has a surface compressive stress of about 900 MPa to 1,500 MPa.

11. The cutting element as recited in claim 9 wherein the polycrystalline diamond has a dome-shaped surface, wherein the polycrystalline diamond is in the form of a diamond table, and a substrate is attached to the diamond table, and wherein the surface compressive stress is between about 900 to 1,500 MPa.

12. A bit for drilling subterranean formations comprising a body and at least one of the cutting elements as recited in claim 9 operatively attached thereto.

* * * * *